US009243437B1

(12) United States Patent
Jeffries et al.

(10) Patent No.: US 9,243,437 B1
(45) Date of Patent: Jan. 26, 2016

(54) DOOR SEQUENCER

(71) Applicant: Austin Hardware & Supply, Inc., Buford, GA (US)

(72) Inventors: Mark Steven Jeffries, Buford, GA (US); Norman Allen Smith, Buford, GA (US)

(73) Assignee: Austin Hardware And Supply, Inc., Lee's Summit, MO (US)

( * ) Notice: Subject to any disclaimer, the term of this patent is extended or adjusted under 35 U.S.C. 154(b) by 0 days.

(21) Appl. No.: 14/528,577

(22) Filed: Oct. 30, 2014

Related U.S. Application Data

(60) Provisional application No. 61/897,468, filed on Oct. 30, 2013.

(51) Int. Cl.
*E05F 5/12* (2006.01)
*E05F 1/10* (2006.01)
*A47B 81/00* (2006.01)

(52) U.S. Cl.
CPC ..... *E05F 1/1091* (2013.01); *A47B 81/00* (2013.01); *E05F 5/12* (2013.01)

(58) Field of Classification Search
CPC ..... E05C 7/04; E05F 5/12; E05F 1/1091; A47B 81/00; E05B 65/025; E05Y 2900/21
USPC ..... 312/215, 222, 324, 326, 329, 319.1, 312/319.2, 409; 49/366, 367
See application file for complete search history.

(56) References Cited

U.S. PATENT DOCUMENTS 4,583,324 A * 4/1986 Storz ..... E05F 5/12 49/367
4,619,076 A * 10/1986 Livingston ..... A62C 2/248 49/367
4,653,229 A * 3/1987 Feucht ..... E05F 3/223 16/58
4,967,512 A * 11/1990 Schroder ..... E05F 5/12 16/82
5,033,234 A * 7/1991 Simon ..... E05F 5/12 292/DIG. 21
5,061,022 A * 10/1991 Meriwether ..... E05C 7/04 292/33
5,582,472 A * 12/1996 Lyons ..... A47B 81/00 292/238
5,944,399 A * 8/1999 Gillispie ..... E05F 1/006 312/324
5,992,098 A * 11/1999 Flider ..... A62C 2/241 49/367
8,029,079 B2 * 10/2011 Reich ..... B01D 3/148 312/324
8,651,595 B2 * 2/2014 Backhaus ..... E05F 1/006 312/324

* cited by examiner

*Primary Examiner* — James O Hansen
(74) *Attorney, Agent, or Firm* — Polsinelli PC

(57) ABSTRACT

A cabinet with a door sequencer is described. The cabinet includes a first door and a second door to close an opening of the cabinet. A first gas spring closes the first door before a second gas spring closes the second door. The door sequencer automatically closes the first and second doors in a correct order to promote compliance with safety regulations.

20 Claims, 5 Drawing Sheets

DOOR SEQUENCER

CROSS REFERENCE TO RELATED APPLICATION

This application claims the benefit of U.S. Provisional Application No. 61/897,468 filed Oct. 30, 2013, which is hereby incorporated by reference in its entirety.

FIELD OF INVENTION

The present invention relates to a door sequencer.

BACKGROUND

In order to comply with various local, state and federal safety regulations, cabinets enclosing certain volatile chemicals must be maintained in a properly closed position. The cabinets protect the chemicals from heat during a fire. These cabinets may be referred to as "safety cabinets." Typically, doors of these cabinets must be closed in a proper sequence in order for the doors to be properly closed. Unfortunately, workers may forget to fully close the cabinet, or the workers will close the cabinet in an improper manner, which may lead to violation of the safety regulations.

SUMMARY

A door sequencer is described. The door sequencer automatically closes the doors of a cabinet, such as doors of a safety cabinet, in a correct order. The door sequencer promotes compliance with safety regulations. Typical safety cabinets include a first door and a second door and are designed such that one of the doors, for example, the first door, must close before the second door. This provides for proper sealing of the doors. The door sequencer includes a toggle that only permits the second door to close after the first door has already closed. A first spring assembly is engaged to the first door to cause the first door to close. A second spring assembly is engaged to the second door to cause the second door to close. When the first door closes, the first spring assembly contacts the toggle, to change the position of the toggle, which permits the second door to close. The toggle blocks the second door from closing until the first door has closed.

In one aspect, a cabinet with a door sequencer is described. The cabinet includes a first door and a second door to close an opening of the cabinet. A first gas spring includes a first extension end and a first base end. A first cable is engaged to the first door and to the first extension end. A second gas spring includes a second extension end and a second base end. A striker is fixedly engaged to the second door. A second cable is engaged to the striker of the second door and to the second extension end. A toggle is engaged to the cabinet, wherein the toggle is movable between blocking and closing positions with respect to the striker.

In another aspect a door sequencer is described. The door sequencer includes a first spring assembly. The first spring assembly includes a first gas spring, a first cable, and a first pulley. A second spring assembly includes a second gas spring, a second cable, and a second pulley. A cam assembly includes a housing, a toggle, a striker. The toggle pivots between a first position to block the striker and a second position to allow movement of the striker. Either the first or the second gas spring engages the toggle to cause the toggle to move to the second position.

In another aspect, a cabinet with a door sequencer is described. The cabinet includes a first door and a second door to close an opening of the cabinet. The first door and the second door are hingedly engaged to the cabinet. A first gas spring includes a first extension end and a first base end. A first cable is engaged to the first door and to the first extension end. A second gas spring includes a second extension end and a second base end. A striker is fixedly engaged to the second door. A second cable is engaged to the striker of the second door and to the second extension end. A shuttle is engaged to the first extension end. A toggle is engaged to the cabinet. The toggle blocks the closing of the second door until the shuttle contacts the toggle and causes the toggle to pivot or rotate out of the way of the striker.

DETAILED DESCRIPTION OF INVENTION

Figure 1:
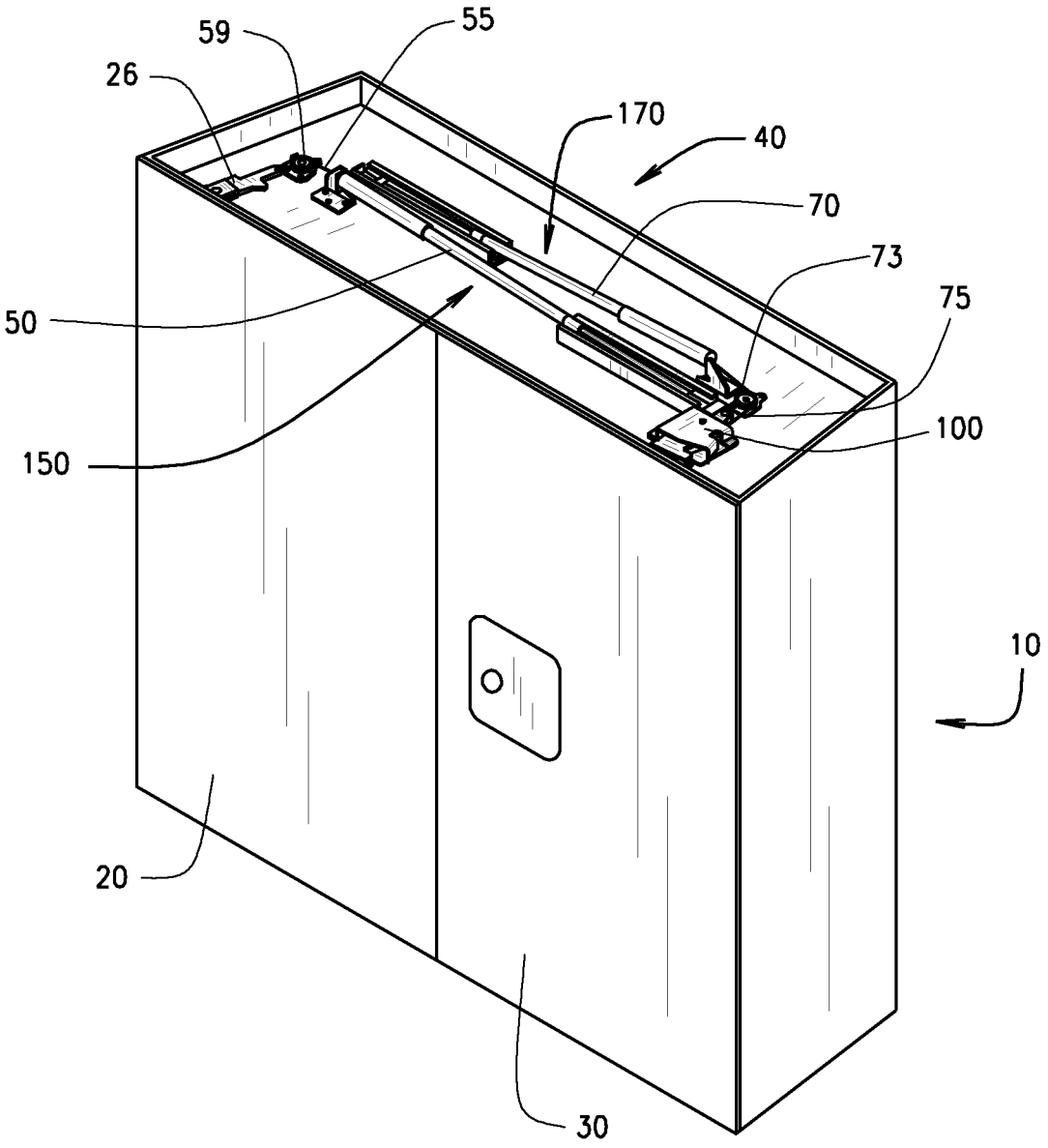
FIG. 1 is a view of the door sequencer installed on the cabinet.
Figure 2:
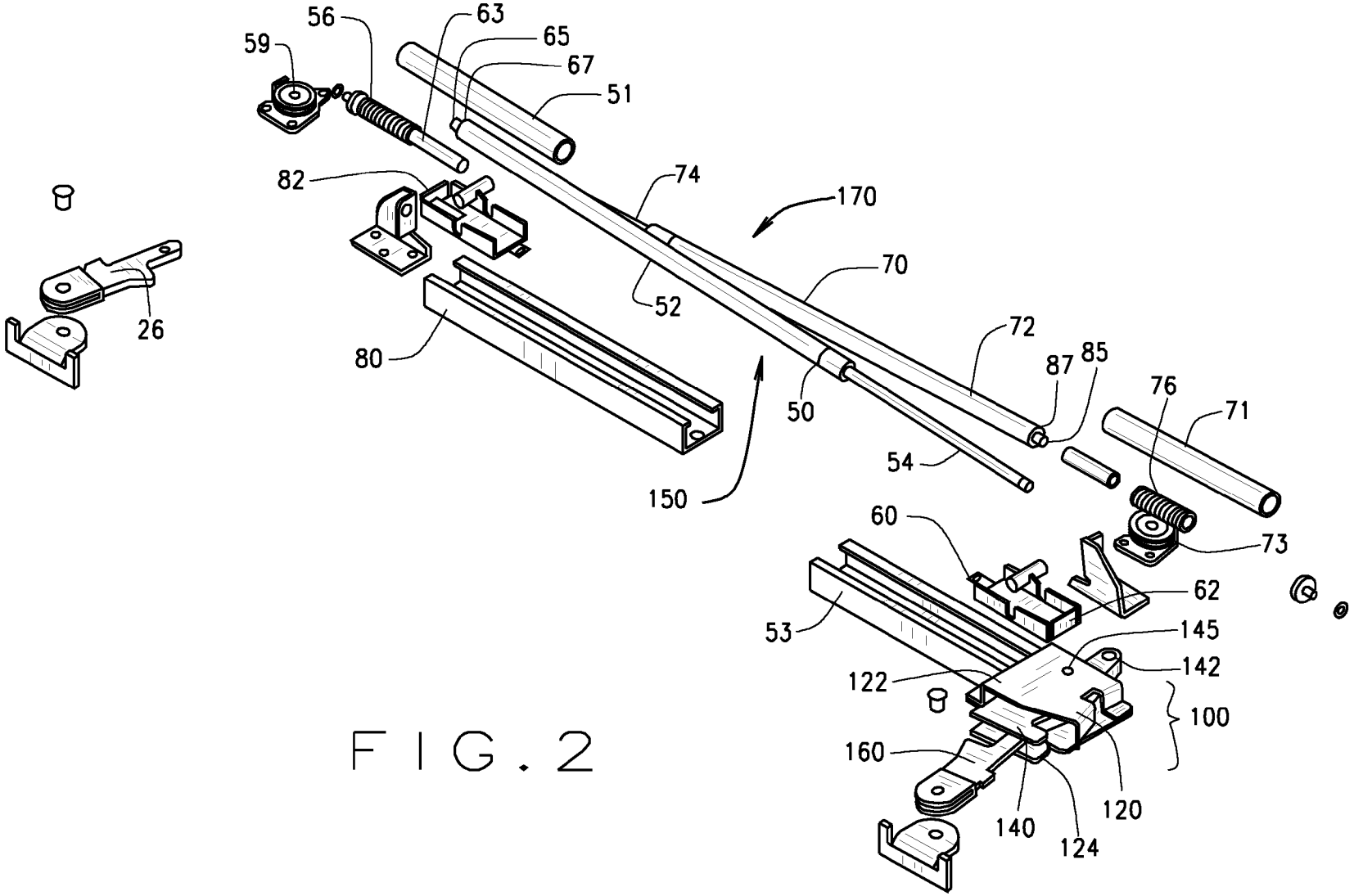
FIG. 2 is an exploded view of the door sequencer.
Figure 3:
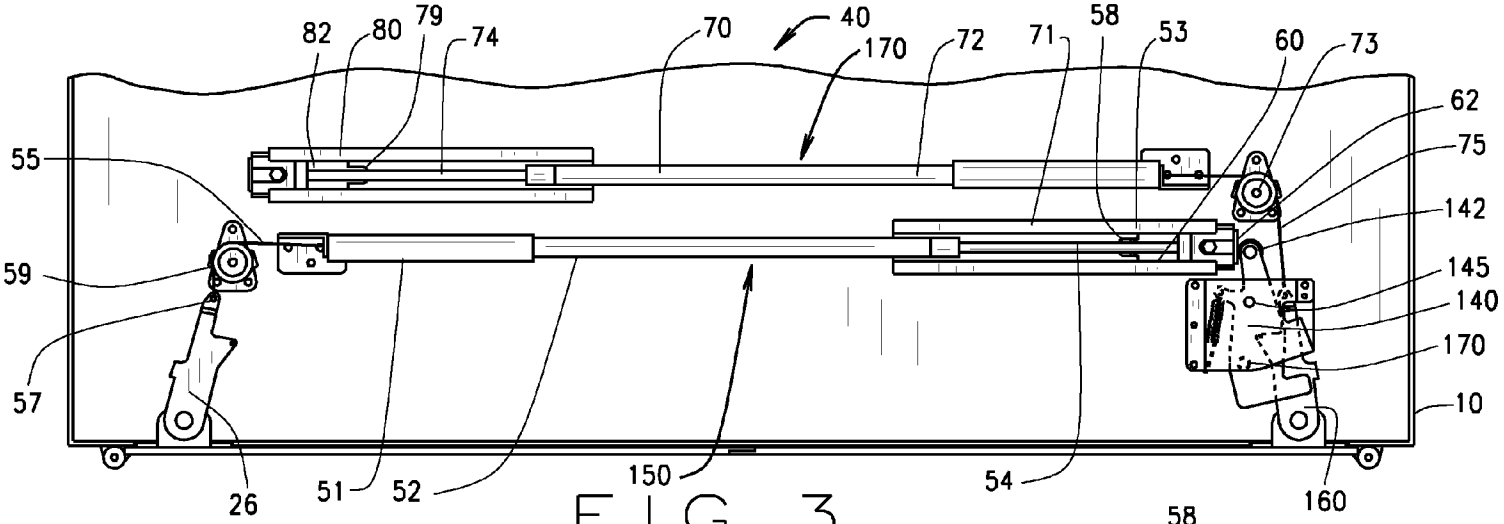
FIG. 3 is a top down view of the door sequencer installed on the cabinet with the doors closed.

With reference to FIGS. 1-8, a cabinet 10 is shown. The cabinet 10 includes a first door 20 and a second door 30. The first and second doors 20, 30 are hingedly connected to the cabinet 10. The cabinet 10 and the first and second doors 20, 30 incorporate a door sequencer 40. The door sequencer 40 automatically closes the first and second doors 20, 30 in the proper sequence.

The first and second doors 20, 30 cover an opening 12 and an interior 14 of the cabinet 10. The first door 20 includes a flange 25. In order for the cabinet 10 to properly close, the first door 20 must close before the second door 30. The second door 30 closes over the flange 25 of the first door 20, which generally seals the cabinet 10 closed. In the aspect shown in FIGS. 1-8, the first door 20 is on a left side of the cabinet 10 and the second door 30 is on a right side of the cabinet 10. Of course, the order of the doors 20, 30 closing and their engagement to the door sequencer 50 may be reversed, i.e., the second door 30 may close first.

The door sequencer 40 includes a first spring assembly 150, which includes a first gas spring 50. The door sequencer 40 also includes a second spring assembly 170, which includes a second gas spring 70. The first gas spring 50 is compressed when the first door 20 is opened, such as by an operator pulling on or opening the first door 20 to access the interior 14 of the cabinet 10. Likewise, the second gas spring 70 is compressed when the second door 30 is opened. In the exemplary arrangement shown in FIGS. 1-8, the second door 30 is opened prior to the first door 20. The second door 30 includes the door handle and also covers the flange 25 of the first door 20. Once the doors 20 and 30 are opened, the door sequencer 40 prevents the second door 30 from closing before the first door 30 closes. After the operator releases the first door 20, the force of the first gas spring 50, expanding back to its relaxed or extended position, biases or pulls the first door 20 toward the closed position. Likewise, after the operator releases the second door 30, the force of the second gas spring 70, expanding back to its relaxed or extended position, biases or pulls the second door 30 toward the closed position.

A cam assembly 100 ensures that the first door 20 closes before the second door 30 closes. The cam assembly 100 generally includes a housing 120, a toggle 140, and a striker 160. The striker 160 is pivotally mounted to the second door 30. The housing 120 may be mounted to the cabinet 10, such as on a top surface of the cabinet 10 or it may be built into the upper portions of the cabinet 10.

The toggle 140 is rotatably or pivotally mounted to the housing 120. The toggle 140 includes a catch 170. The catch 170 stops the travel of the striker 160—and thus the travel of the second door 30. The toggle 140 rotates relative to an axis 145. The toggle 140 may rotate just enough such that the catch 170 is movable out of the way of a locking surface 165 of the striker 160. The axis 145 is engaged to an upper surface 122 and a lower surface 124 of the housing 120. The axis 145 is generally stationary relative to the housing 120. The toggle 140 may rotate approximately 15 degrees to approximately 90 degrees relative to the axis 145.

Figure 4:
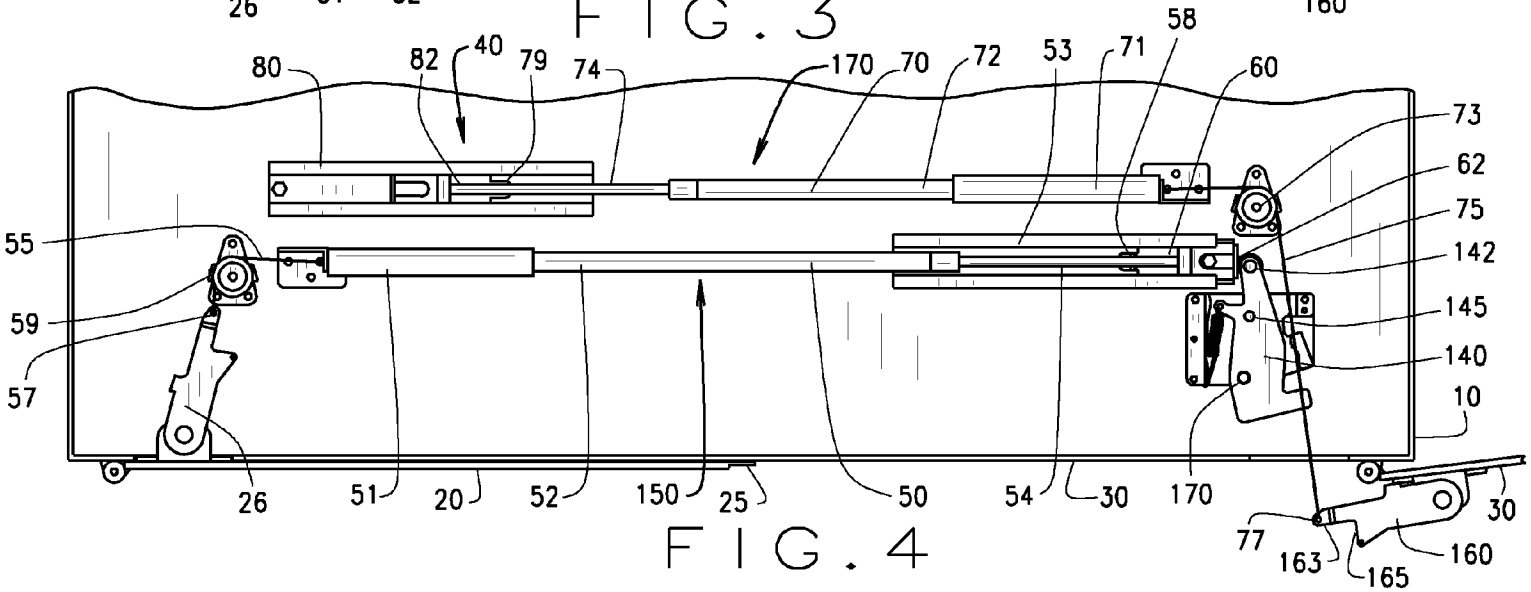
FIG. 4 is a top down view of the door sequencer installed on the cabinet with the second door fully opened.
Figures 5, 6:
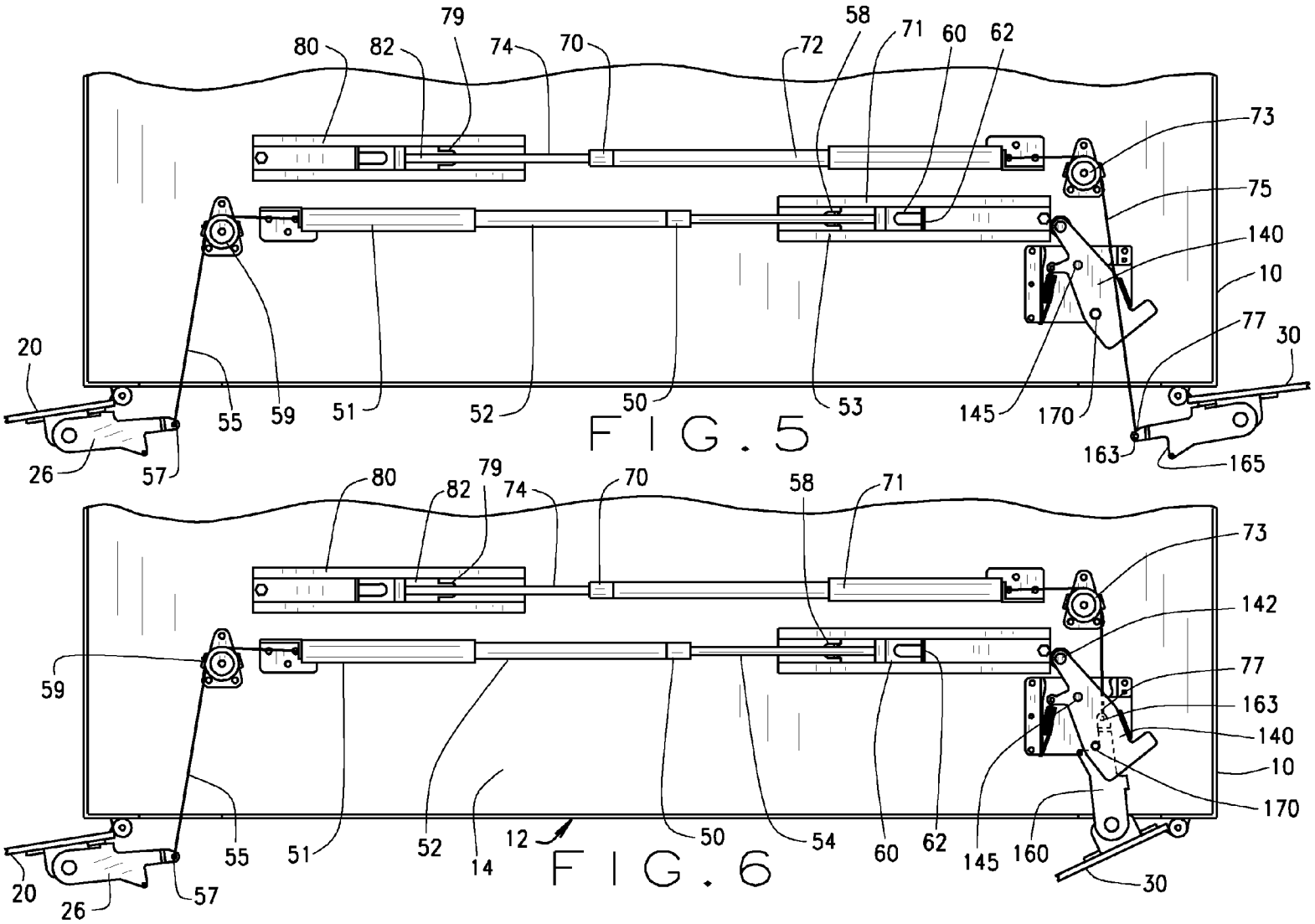
FIG. 5 is a top down view of the door sequencer installed on the cabinet with both doors fully opened.
FIG. 6 is a top down view of the door sequencer installed on the cabinet with the second door held open by the toggle.
Figure 7:
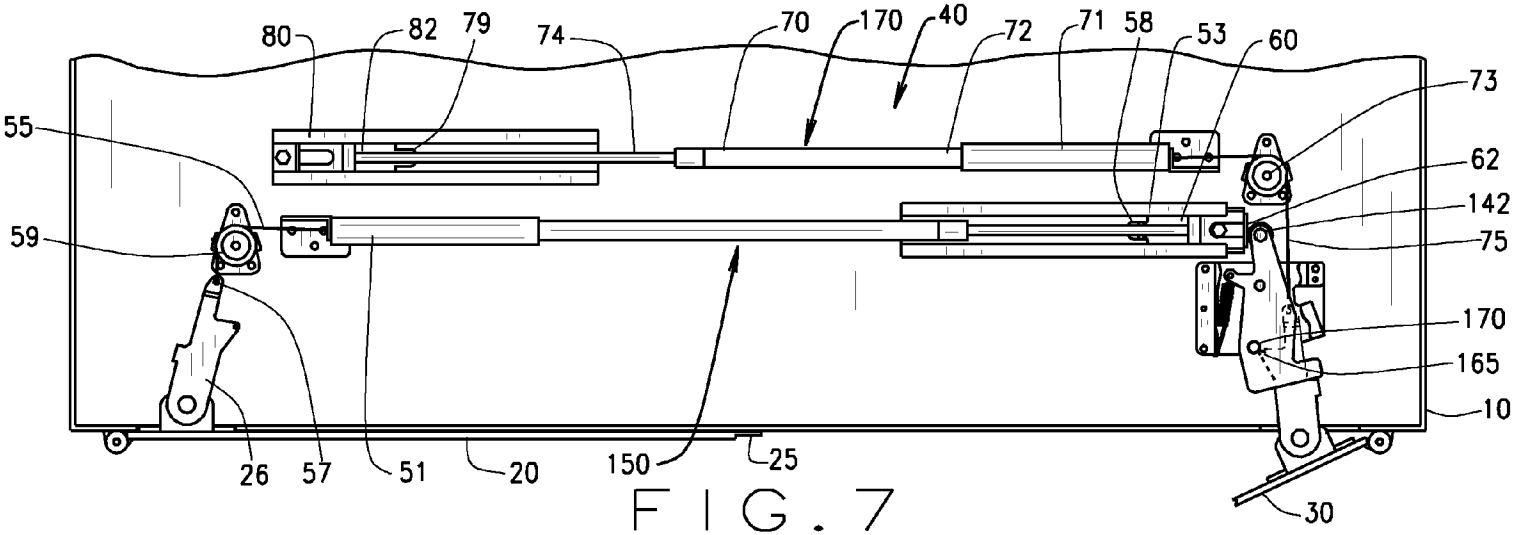
FIG. 7 is a top down view of the door sequencer installed on the cabinet with the striker contacting the toggle.
Figure 8:
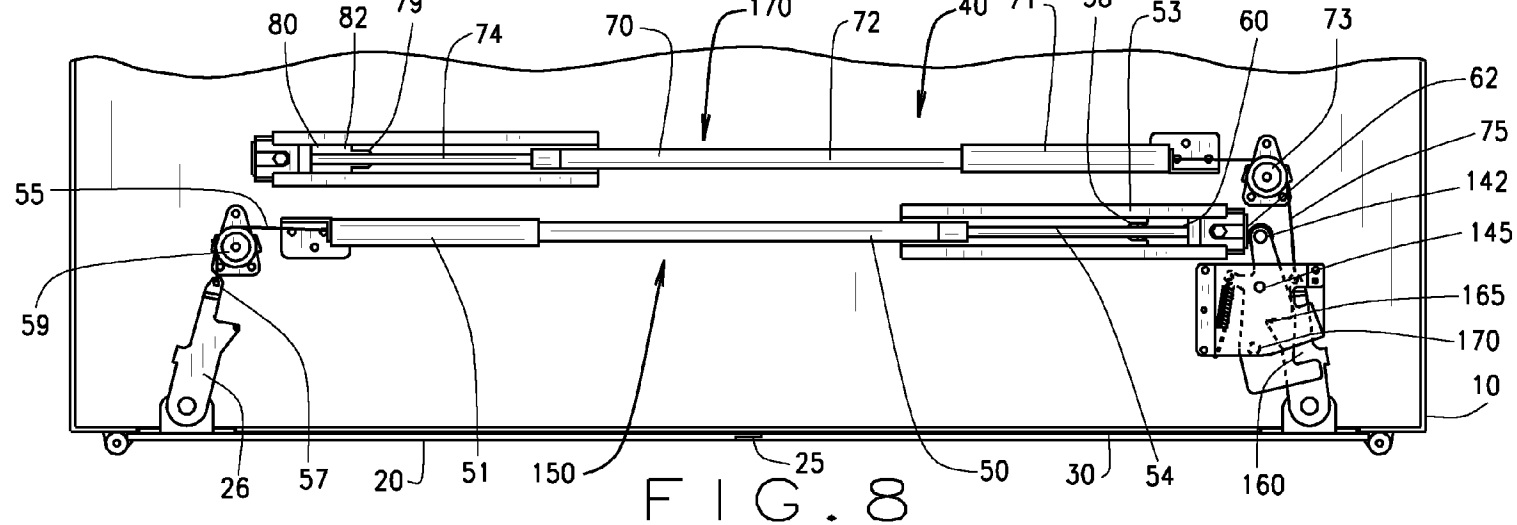
FIG. 8 is a top down view of the door sequencer installed on the cabinet with the doors closed.

As shown in FIG. 4, the striker 160 includes the locking surface 165 that engages the catch 170. The catch 170 may physically stop the inward movement of the striker 160. The catch 170 is positioned between the upper surface 122 and the lower surface 124 of the housing 120. As the striker 160 moves inward, the locking surface 165 strikes the catch 170, which stops the closing of the second door 30. The catch 170 may include a member, such as a rod, bolt, or other structure that lockingly engages to the locking surface 165 of the striker 160. The locking surface 165 may include a bend, corner, or other engaging member that engages the catch 170. The catch 170 prevents the locking surface 165 of the striker 160 from moving further toward the interior 14 of the cabinet 10. As such, the catch 170 stops the closing of the second door 30. When the toggle 140 rotates, the catch 170 is moved out of the way of the locking surface 165 of the striker 160. This allows the second door 30 to fully close.

With reference to FIG. 4, a first cable 55 connects the first door 20 to the first spring 50. With reference to FIG. 4, a second cable 75 connects the striker 160 to the second gas spring 70. The first cable 55 and the second cable 75 pull the first door 20 and the second door 30, respectively, to the closed positions. In greater detail, the striker 160 is pivotally and fixedly engaged to the second door 30. The striker 160 may be connected to an interior surface of the second door 30. The second cable 75 attaches to the striker 160. As shown in FIG. 4, the second cable 75 attaches directly to a leading end 163 of the striker 160. When the first door 20 is opened, the first cable 55 urges an extension end 54 of the first gas spring 50 into a base end 52 of the first gas spring 50 (against the force of the first gas spring 50). The first cable 55 pulls on the extension end 54 of the first gas spring 50 in a direction generally opposite to an extension direction of the first gas spring 50. This compresses the first gas spring 50. The first cable 55 is positioned generally parallel to a length of the first gas spring 50. When the user lets go of the first door 20, the first gas spring 50 extends and pulls the first door 20 closed via the first cable 55. Similarly, the second cable 75 is positioned generally parallel to a length of the second gas spring 70 and pulls the second door 30 closed.

The first gas spring 50 and the second gas spring 70 may include a gas spring. A suitable gas spring includes the GENESIS brand spring commercially available from Austin Hardware of Lee Summit, Missouri. Gas springs return to their relaxed state in a slower manner than other types of springs, which helps prevent the doors 20, 30 from abruptly slamming closed. The first gas spring 50 includes the base end 52 and the extension end 54. During application of a compression force to the first gas spring 50 by the operator, such as by opening the door 20, the first cable 55 pulls the extension end 54 toward the base end 52 compressing the first gas spring 50, the extension end 54 retracts into the base end 52, and thus shortens the overall length of the first gas spring 50. When the compression force on the first gas spring 50 is no longer present, the extension end 54 returns or extends to its fully extended state, which is its relaxed position 50, and pulls the first door 20 closed via the first cable 55. In other aspects, different types of spring members, such as mechanical springs, may be employed.

Due to the toggle 140, the second door 30 cannot close until the first door 20 is already closed. The closing of the first door 20 causes the toggle 140 to rotate out of the way of the striker 160. Specifically, as the first gas spring 50 extends, a shuttle 60 engaged to the first gas spring 50 contacts or pushes the toggle 140 to cause it to rotate about the axis 145. A leading end 62 of the shuttle 60 strikes a roller 142 attached to the toggle 140, causing the toggle 140 to pivot on its axis 145. The toggle 140 pivots out of the way of the striker 160, which permits the second door 30 to close. The toggle 140 pivots between a blocking position and a closing position. In the blocking position, the catch 170 stops the striker 160 and the second door 30. In the closing position, the catch 170 is moved out of the way of the striker 160, and the second door 30 may close.

The first gas spring 50 and the second gas spring 70 are generally aligned in opposite directions, i.e., the extension end 54 of the first gas spring 50 is positioned next to the base end 72 of the second gas spring 70. Likewise, the extension end 74 of the second gas spring 70 is positioned next to the base end 52 of the first gas spring 50.

The first spring assembly 150 generally includes the first gas spring 50, a first spring housing 51, the first cable 55, a first pulley 59, a track 53, and the shuttle 60. The first spring housing 51 holds the base end 52 of the first gas spring 50. The first spring housing 51 includes a spring 56 that biases the base end 52 of the first gas spring 50 in the direction of extension of the extension end 54. A plug 63 is positioned in the internal diameter of the spring 56. The plug 63 and the spring 56 are generally positioned in the interior of the first spring housing 51. A nut 65 connects the base end 52 of the first gas spring 50 to the plug 63. The base end 52 has a larger external diameter 67 than the plug 63. The external diameter 67 presses against the spring 56 in order to compress the spring 56. The plug 63 helps to maintain the shape of the spring 56 and prevent the spring 56 from tangling. The plug 63 also provides a limit to the compression of the spring 56. The spring 56 also reacts faster than the first gas spring 50, and pushes the base end 54 to increase an overall length of the first spring assembly 150 in order to reduce slamming of the first door 20. The spring 56 helps to maintain tension on the first cable 55 to prevent tangling of the first cable 55. A first end 57 of the first cable 55 attaches to a bracket 26 on an interior side of the first door 20. A second end 58 of the first cable 55 attaches to the shuttle 60. The shuttle 60 fixedly engages the extension end 54 of the first gas spring 50.

The extension of the extension end 54 of the first gas spring 50 moves the shuttle 60, as the first cable 55 connects the extension end 54 of the first gas spring and the shuttle 60. The shuttle 60 is movably mounted to the track 53. As shown in FIG. 4, the extension end 54 is engaged to the shuttle 60.

When the first door 20 is allowed to close, the extension of the extension end 54 of the first gas spring 50 pulls the door 20 closed and moves the shuttle 60 to contact the toggle 140, which allows the second door 30 to close. As the first door 20 is almost closed or already moving to the closed position before the shuttle 60 contacts the toggle 140, the first door 20 closes before the second door 30.

The second spring assembly 170 includes the second gas spring 70, a second spring housing 71, the second cable 75, a second pulley 72, a second track 80, and a second shuttle 82, and a second spring 76. A first end 77 of the second cable 75 attaches to the leading end 163 of the striker 160. The second cable 75 engages the second pulley 73 to change the direction of the second cable 75. A second end 79 of the first cable 55 attaches to the shuttle 82. The extension end 74 of the second gas spring 70 fixedly engages the shuttle 82. The second cable 75 connects the extension end 74 of the second gas spring 70 and the shuttle 82. The extension of the extension end 74 moves the shuttle 82, which pulls on the second cable 75 to close the second door 30.

A plug 83 is positioned in the internal diameter of the spring 76. The plug 83 and the spring 76 are generally positioned in the interior of the second spring housing 71. A nut 85 connects the base end 72 of the second gas spring 70 to the plug 83. The base end 72 has a larger external diameter 87 than the plug 83. The external diameter 87 presses against the spring 76 in order to compress the spring 76. The plug 83 helps to maintain the shape of the spring 76 and prevent the spring 76 from tangling. The plug 83 also provides a limit to the compression of the spring 56.

As shown in FIG. 1, components of the first spring assembly 150 and the second spring assembly 170 may be mounted to the upper surface of the cabinet 10. In operation of the cabinet 10 with the door sequencer 40, the door sequencer 40 prevents the second door 30 from closing before the first door 20. The door sequencer 40 prevents the second door 30 from closing on top of the first door 20. The toggle 140 holds the second door 30 from closing until the shuttle 60 strikes the toggle 140 causing the toggle 140 to pivot and move the catch 170 out of the way of the locking surface 165 of the striker 160. Once the catch 170 is moved out of the way of the locking surface 165 of the striker 160, the second door 30 can close.

In the aspect of FIGS. 1-8, the second door 30 (in this particular arrangement), must always open first as the door handle is located on the second door 30 and the second door 30 also covers the flange 25 of the first door 20. The second door 30 can be opened at any time without first opening the first door 20. Once the second door 30 is opened, then the first door 20 may be opened. The door sequencer 40 is engaged after the both doors 20 and 30 have been opened beyond approximately 15° or so from their closed positions. The second door 30 needs to be opened first to allow the first door 20 to open since the second door 30 covers the flange 25 of the first door 20 to seal the cabinet 10. Once the second door 30 has been opened far enough, the first door 20 may then be opened, which will engage the door sequencer 40 to prevent the second door 30 closing prior to the first door 20. Due to the door sequencer 40, the second door 30 will not close until the first door 20 is closed.

It should be understood from the foregoing that, while particular embodiments of the invention have been illustrated and described, various modifications can be made thereto without departing from the spirit and scope of the present invention. Therefore, it is not intended that the invention be limited by the specification; instead, the scope of the present invention is intended to be limited only by the appended claims.

What is claimed is:

1. A cabinet with a door sequencer, comprising:

a first door and a second door to close an opening of a cabinet;

a first gas spring comprising a first extension end and a first base end;

a first cable, the first cable engaged to the first door and to the first extension end;

a second gas spring comprising a second extension end and a second base end;

a striker fixedly engaged to the second door;

a second cable, the second cable engaged to the striker of the second door and to the second extension end; and, a toggle engaged to the cabinet, wherein the toggle is movable between blocking and closing positions with respect to the striker.

2. The cabinet according to claim 1, wherein the door sequencer prevents the second door from closing before the first door.

3. The cabinet according to claim 1, wherein the striker includes a locking surface, wherein the toggle include a catch, wherein the locking surface engages the catch.

4. The cabinet according to claim 1, wherein the toggle includes a catch, and the catch stops the striker and the second door.

5. The cabinet according to claim 1, further comprising a shuttle, and the extension of the first extension end of the first spring moves the shuttle to contact the toggle.

6. The cabinet according to claim 5, wherein the shuttle is movably mounted to a track.

7. The cabinet according to claim 5, wherein a closing of the first door causes the first extension end of the first spring to move the shuttle to contact the toggle, which allows the second door to close.

8. The cabinet according to claim 5, wherein the toggle holds the second door from closing until the shuttle strikes the toggle causing the toggle to pivot and move a catch out of the way of a locking surface of the striker.

9. The cabinet according to claim 1, wherein a first spring housing holds the first base end of the first gas spring, and the first spring housing includes a spring that biases the first base end of the first gas spring in the direct of extension of the extension end.

10. The cabinet according to claim 1, further comprising a first spring housing and a second spring housing, wherein the first spring housing holds the first base end of the first gas spring and includes a first spring that biases the first base end of the first gas spring in the direction of extension of the first extension end; wherein the second spring housing hold the second base end of the second gas spring and includes a second spring that biases the second base end of the second gas spring in the direct of extension of the second extension end.

11. The cabinet according to claim 1, further comprising a first spring assembly and a second spring assembly, wherein the first spring assembly comprises the first gas spring, the first cable, a first pulley, a track, a shuttle, and a first spring housing, wherein the first spring housing includes a first spring that biases the first base end of the first gas spring in the direction of extension of the first extension end; wherein the second spring assembly includes the second gas spring, the second cable, a second pulley a second spring housing, wherein the second spring housing includes a second spring that biases the second base end of the second gas spring in the direction of extension of the second extension end.

12. The cabinet according to claim 1, wherein the first gas spring and the second gas spring are generally aligned in opposite directions.

13. The cabinet according to claim 1, wherein the door sequencer automatically urges the first door to a closed position before closing the second door.

14. The cabinet according to claim 1, wherein upon closing of the first door, the first gas spring contacts the toggle to permit the second door to close.

15. The cabinet according to claim 1, wherein the toggle blocks the second door from closing until the first door has closed.

16. A cabinet with a door sequencer, comprising:

a first door and a second door to close an opening of a cabinet, wherein the first door and the second door are hingedly engaged to the cabinet;

a first gas spring comprising a first extension end and a first base end;

a first cable, the first cable engaged to the first door and to a first shuttle, the first shuttle engaged to the first extension end;

a second gas spring comprising a second extension end and a second base end;

a striker fixedly engaged to the second door;

a second cable, the second cable engaged to the striker of the second door and to a second shuttle, the second shuttle engaged to the second extension end; and, a toggle engaged to the cabinet, wherein the toggle blocks the closing of the second door until the first shuttle contacts the toggle and causes the toggle to pivot or rotate out of the way of the striker.

17. A cabinet with a door sequencer, comprising:

a first door and a second door to close an opening of a cabinet;

a first spring assembly, wherein the first spring assembly comprises a first gas spring, a first cable, and a first pulley;

the first cable engaged to the first door and to the first gas spring;

a second spring assembly, wherein the second spring assembly comprises a second gas spring, a second cable, and a second pulley;

a cam assembly, wherein the cam assembly generally includes a housing, a toggle, and a striker;

the second cable engaged to the striker and to the second gas spring;

wherein the toggle pivots between a first position to block the striker and a second position to allow movement of the striker, wherein either the first or the second gas spring engages the toggle to cause the toggle to move to the second position.

18. The cabinet with a door sequencer according to claim 17, further comprising a track and a shuttle.

19. The cabinet with a door sequencer according to claim 17, further comprising a spring housing, wherein the spring housing includes a spring that biases a base end of the first gas spring in a direction of extension of a first extension end of the first gas spring or biases a base end of the second gas spring in the direction of extension of a second extension end of the second gas spring.

20. The cabinet with a door sequencer according to claim 17, wherein the door sequencer prevents the second door from closing before the first door.

* * * * *